US005193564A

United States Patent [19]

Agulloó-Negui

[11] Patent Number: 5,193,564

[45] Date of Patent: Mar. 16, 1993

[54] DIP WASHING MACHINE FOR MACHINED PARTS

[75] Inventor: Miguel Agulloó-Negui, Barcelona, Spain

[73] Assignee: Ingenieria Agullo, S.A., Barcelona, Spain

[21] Appl. No.: 761,393

[22] Filed: Sep. 18, 1991

[30] Foreign Application Priority Data

Sep. 24, 1990 [ES] Spain ..... 90002440

[51] Int. Cl.[5] ..... B08B 3/02

[52] U.S. Cl. ..... 134/155; 134/157; 134/186; 134/200

[58] Field of Search ..... 134/200, 186, 155, 111, 134/76, 55, 54, 170, 160 R, 153, 157, 158

[56] References Cited

U.S. PATENT DOCUMENTS

| | | | |
|---|---|---|---|
| 3,512,539 | 5/1970 | Hamilton | 135/155 |
| 4,132,235 | 1/1979 | Koplin | 134/200 X |
| 4,134,413 | 1/1979 | Noren | 134/200 X |
| 4,867,186 | 9/1989 | Otsuka | 134/166 R X |
| 4,881,561 | 11/1989 | Schwarzalder | 134/170 |
| 4,924,891 | 5/1990 | Soubrier | 134/200 X |
| 5,000,206 | 3/1991 | Kramer et al. | 134/200 X |
| 5,000,207 | 3/1991 | Titterington et al. | 134/44 |

FOREIGN PATENT DOCUMENTS

| | | |
|---|---|---|
| 0341184 | 11/1989 | European Pat. Off. . |
| 2922213 | 9/1980 | Fed. Rep. of Germany . |

*Primary Examiner*—Frankie L. Stinson

*Attorney, Agent, or Firm*—Cushman Darby & Cushman

[57] ABSTRACT

A dip washing machine for machined parts including transfer bar for the parts and at least one washing station in which the part is dipped in a bath of washing liquid. The bath is formed by a generally cubical casing, the surfaces of which are formed by a side wall and a bottom, attached to the machine frame, and by a complementary shell including a front surface, a rear surface, a side surface and a top wall. The bottom is provided with an aperture for the passage of the transfer bars and the side surface is provided with a port for the quick filling of the bath. The shell moves upwardly and downwardly, so that it alternately opens and closes the port and the bath, at the same time as it allows for the loading and discharging of the parts.

4 Claims, 2 Drawing Sheets

DIP WASHING MACHINE FOR MACHINED PARTS

BACKGROUND OF THE INVENTION

The present invention relates to a dip washing machine for machined parts, of the type which comprises transfer bars for the parts to be washed on a common bed frame, and at least one washing station, in which the part is dipped all or in part in a bath which may contain a washing liquid. The washing liquid comes from a filter system and the dirty washing liquid is collected below the washing station and then led to the filter system. The parts which are to be washed are fed by the transfer bars, which have a step-by-step movement, and insert them successively in the baths of the washing stations. In the washing stations, the parts are retained during the washing operation by holders in a support frame inserted inside the bath and attached to a rotating shaft crossing through a side wall of the bath support.

Several types of machined parts washing machines are already known, in which the washing is effected by dipping the parts in a washing liquid. The great majority of such machines have the drawback that they use a large amount of washing liquid, which must then be filtered and recycled, at the same time as a relatively large amount of washing liquid is lost every time the part is inserted in or removed from the washing bath.

To eliminate this drawback, the machine of European Patent Application 0341184, of which the applicant is the owner, was developed.

Nevertheless, in all the machines known to date, the mechanism causing the part to rotate is inserted in the washing bath and submerged in the washing liquid, or at least exposed to splashing by the washing liquid, which represents a greater risk of degradation of the mechanism.

Furthermore, in the known machines, the filling and draining downtimes of the washing baths are relatively long. This, together with the complexity of the movements of large heavy mechanical blocks from their operative positions to the discharge or rest positions and vice versa, means that the parts washing time in actual practice is substantially longer than is desirable.

A further drawback which is commonly found in the known washing machines is that the mechanisms allowing the cross transfers of the parts to the different operative stations to be carried out, take up a large amount of space and substantially hinder access to the interior of the machine, for example for maintenance thereof.

SUMMARY OF THE INVENTION

The machine of the present invention completely eliminates all the above-mentioned drawbacks and allows a short washing cycle to be obtained by taking advantage of the stepwise parts transfer system which is the simplest and least subject to faults, at the same time as it makes maximum use of the washing liquid.

The machine in question is characterized in that the bath is formed by a generally cubic casing, the surfaces of which are formed in the first place by the side support wall and by the bottom which are fixedly attached to the machine frame, and from which the support wall separates the support frame, inserted in the bath, from the rotating shaft drive mechanisms, which are completely isolated from the washing liquid. The cubic casing is completed by a complementary hollow shell having a front surface, a rear surface, a second side surface opposite the support surface and a top wall, the bottom of the bath being provided with a longitudinal aperture adapted to allow passage of the transfer bars, disposed below the bath, with the second side surface being provided at the upper portion thereof with a large port adapted to face, during the washing operation and for quick filling of the bath, a large filling aperture formed in the lower end of a conduit connected to the clean washing liquid reservoir. The complementary hollow shell is provided with an upward and downward movement such that it may occupy a first operative lower position, in which the shell port is aligned with the lower aperture of the conduit connected to the clean washing liquid reservoir, and a second upper, standby position, in which the lower portion of said second shell side surface closes the washing liquid conduit aperture, the arrangement being such that in the upper standby position of the complementary shell the bath is empty and the washing liquid inlet is closed and the parts to be washed are transferred by the transfer bars, as well as there is effected total draining of the dirty washing liquid contained in the bath and used in the immediately previous cycle, which is collected by a lower sump and recycled for filtration, while in the lower operative position of the complementary shell, the bath is filled with clean washing liquid and the washing operation is effected.

According to a further feature of the invention, the upward movement of the complementary hollow shell is synchronized and combined with the movement of the transfer bars so that the upward stroke of the shell is sufficient to allow loading and discharging of the parts from the interior of the bath.

In accordance with a further feature of the invention, one side of the shell, preferably the top wall, is traversed by a pipe connected to the clean washing liquid reservoir through pressure means and terminating in a nozzle, to be submerged in the washing liquid contained in the bath and provided with one or several liquid discharge orifices, which liquid exits under pressure from the orifices and impinges on the part being washed in the washing operation, at the same time as the liquid in the bath is stirred.

According to a further feature of the invention, the complementary shell is moved slightly upwardly immediately after complete filling of the bath which produces a small gap between the lower edges of the front, rear and side surfaces of the shell relative to the edges of the bath bottom, so as to form a washing liquid exit aperture towards the lower dirty washing liquid collecting sump and to set up a continuous flow of washing liquid through the bath.

In accordance with yet a further feature of the invention, at the top of at least one of the vertical shell walls there is formed an overflow orifice allowing the excess washing liquid to flow from the bath to the lower sump.

BRIEF DESCRIPTION OF THE DRAWINGS

In the accompanying drawings there is shown, as a non-limiting example, one embodiment of the machine of the invention, wherein.

DETAILED DESCRIPTION

Figure 1:
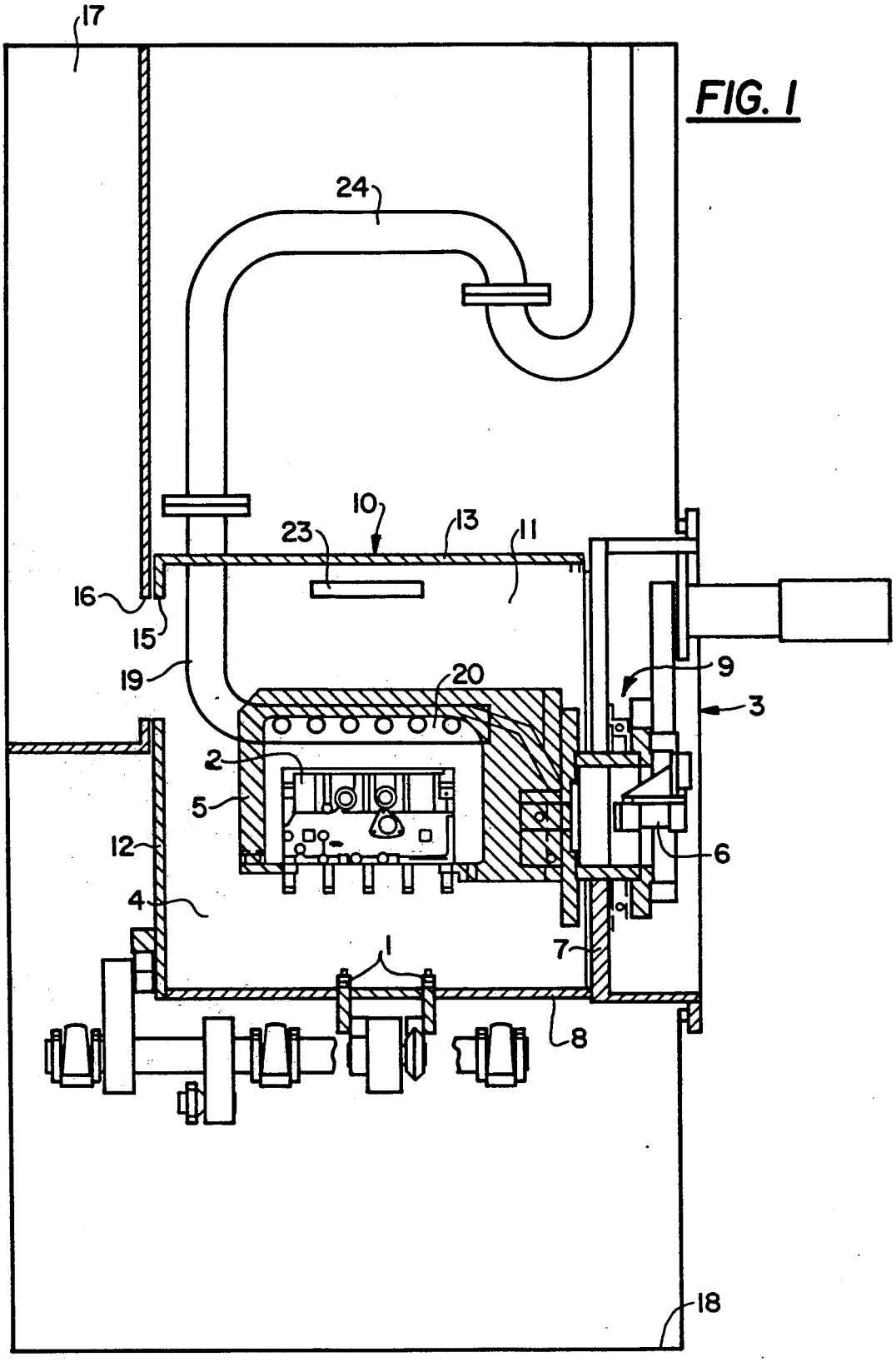
FIG. 1 is a vertical cross-sectional view of a washing station of a parts washing machine embodying principles of the present invention, in the operative washing position.

It may be seen in the drawings how the machine comprises transfer bars 1 of the parts 2 which are to be washed in at least one washing station 3, in which the part 2 is dipped in a bath 4 full of washing liquid.

The parts 2 are fed by the bars 1 using a step-by-step movement, being inserted successively in the washing baths 4. In the baths 4, the parts 2 are firmly held by retaining members, not shown, in a support frame 5 inserted in the bath 4 and fixedly attached to a rotating shaft 6 which traverses through a side support wall 7 of the bath 4.

The bath 4 is formed by a generally cubic casing, the surfaces of which are formed in the first place by the side walls 7 and by the bottom 8, fixedly attached to the frame, of which the side wall 7 separates the support frame 5 from the drive mechanisms 9 of the rotating shafts 6, the mechanisms being totally isolated from the washing liquid.

The casing is complemented by a complementary hollow shell 10 which comprises a front surface, not shown, a rear surface 11, a second side surface 12 opposite the support surface 7 and a top wall 13, the bottom 8 of the bath 4 being provided with a longitudinal aperture 14 for allowing the passage of the transfer bars.

The second side surface 12 is provided at the top with a large port 15 for being aligned in the operative position of FIG. 1 for quick filling of the bath, with a large filling aperture 16 formed in the lower end of a conduit connected to the clean washing liquid reservoir.

Figure 2:
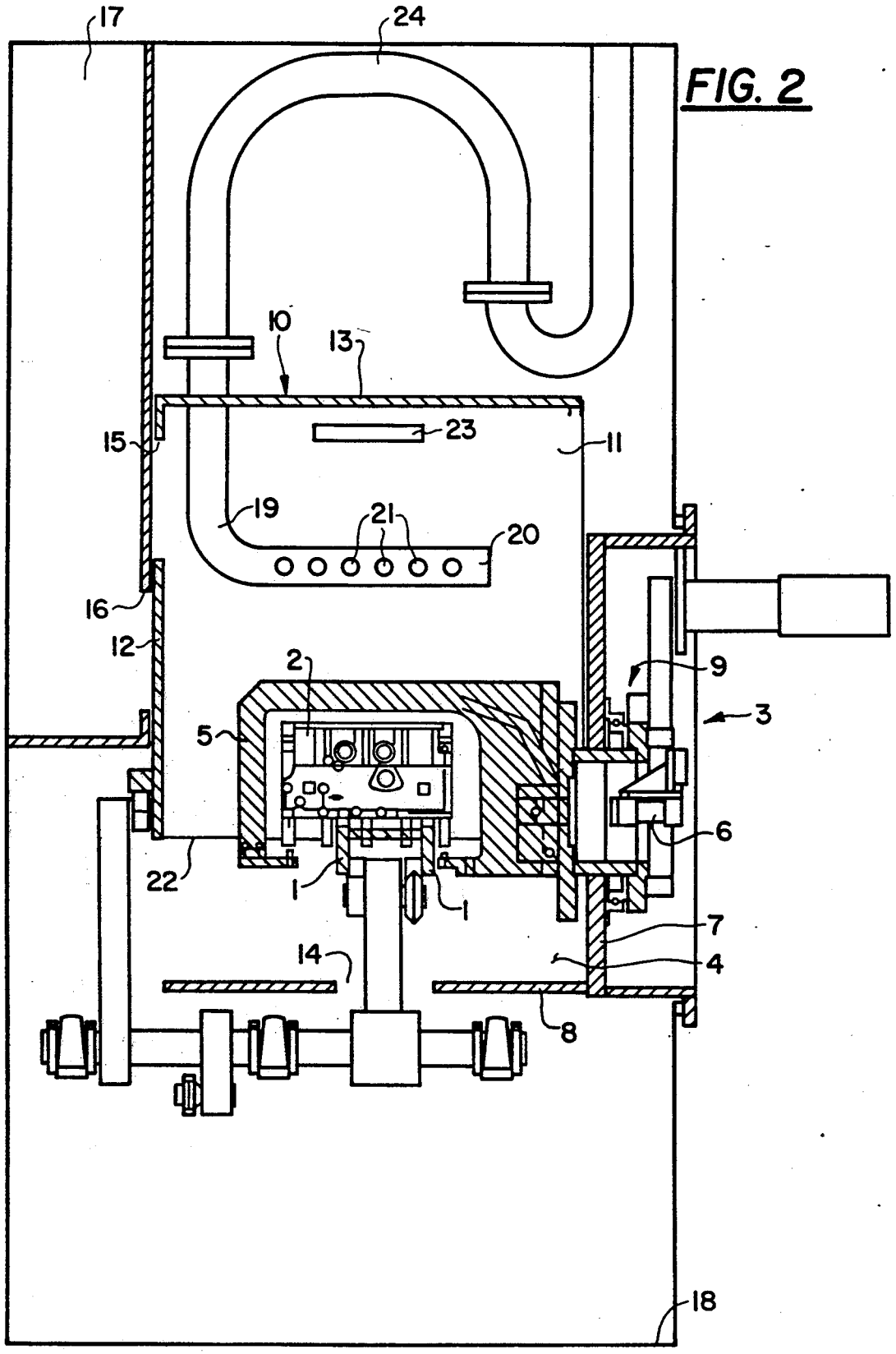
FIG. 2 is a similar view to FIG. 1, but in the parts transfer position.

The shell 10 is provided with an upward and downward movement so that it may occupy a first operative lower position in which the port 15 of the shell 10 is facing the lower aperture 16 of the conduit 17 (FIG. 1) and a second upper standby position in which the lower portion of the second side surface 12 of the shell 10 closes the opening 16 of the conduit 17 (FIG. 2).

Thus, in the standby position (FIG. 2) of the shell 10, the inlet 16 of the washing liquid is closed and the parts 2 are transferred by the transfer bars 1, at the same time as the dirty washing liquid contained in the bath 4 and used in the immediately previous cycle is completely drained out and collected by a lower sump 18 and recycled for filtering, while in the lower position (FIG. 1) of the shell 10, the washing liquid inlet port 15 is open, the bath 4 is filled and the washing operation is carried out.

The upward movement of the shell 10 is combined with that of the transfer bars 1, so that the upper stroke of the shell allows the loading and discharge of the parts 2.

One of the surfaces of the shell 10, preferably the top wall 13 is traversed by a conduit 19 connected to the clean liquid reservoir through pressure means, not shown, terminating in a nozzle 20 for immersion in the washing liquid and provided with several orifices 21 through which the clean washing liquid exits under pressure and impinges on the part 2 while at the same time it stirs the liquid contained in the bath 4. The conduit 19 comprises at least one flexible portion 24, adapted to allow the upward movement of the shell 10.

The shell 10 is moved slightly upward immediately after complete filling of the bath 4 and a small gap is formed between the lower edges 22 of the front surface, rear surface 11 and side surface 12 and the bottom 8. There is thus formed an exit opening for the washing liquid towards the sump 18 and a continuous flow of washing liquid through the bath 4 is set up.

At the top of at least one of the vertical walls of the shell 10 and, in the embodiment illustrated, on the rear surface 11, there is formed an overflow orifice 23 allowing the excess washing liquid to pass from the bath to the lower sump 18.

Having sufficiently described the nature of the invention and the way of reducing it to practice, it is stated that all that does not alter, change or modify its fundamental principle may be subject to variations of detail.

I claim:

1. A dip-washing machine for washing machined parts while the machined parts are supported on a bed, comprising:

a generally cubical casing having a top wall, a bottom wall, a left end wall, a right end wall, a front wall and a rear wall arranged so as to provide a first subassembly comprising said bottom wall, one of said end walls and a conduit for clean washing liquid having an outlet opening, and so as to provide a second subassembly comprising said top wall and the other of said end walls, said other of said end walls having a clean washing liquid inlet port formed therethrough; each of said front and rear walls being included in a respective one of said subassemblies;

a machine frame;

mounting means stationarily mounting said first subassembly of said casing on said machine frame;

sump means associated with said machine frame for effectively providing a sump under said bottom wall of said casing for catching spent washing liquid draining from said casing;

a support frame for parts to be washed, said support frame being disposed within said casing and including means for removably securely holding said parts which are to be washed;

a rotating shaft means penetrating into said casing through said one end wall and being connected to said support frame within said casing for rotating the parts to be cleaned; said rotating shaft means including housing means for isolating shaft drive mechanisms thereof from washing liquid within said casing;

said bottom wall of said casing having means defining a longitudinally extending opening therethrough; and transfer bar means effectively supported on said machine frame by support means extending through said longitudinal opening, for movement between a retracted position, and an extended position for moving the parts to be washed stepwise along said support frame for parts to be washed;

said second subassembly being movable between an elevated position in which a portion of said other end wall effectively closes said outlet opening of said washing liquid conduit, and wash water within said casing is free to drain between said first and second subassemblies into said sump and said casing to completely empty of washing liquids into said sump and said transfer bar means are operable to said extended position thereof, and a lowered position in which said outlet opening of said wash water conduit opens through said inlet port of said other end wall into said casing, and said first and second subassemblies tend to confine wash water in said casing so that rotation of said support frame by said rotating shaft means effects dip washing of the parts to be washed.

2. The dip-washing machine of claim 1, further comprising:

a pipe arranged for connecting outside said casing with a pressurized supply of washing liquid, said pipe penetrating into said casing through one of said walls of said casing, and said pipe terminating within said casing adjacent said support frame and effectively below an expected level of washing liquid in said casing, in nozzle means arranged to impinge pressurized washing liquid on the parts to be washed and by jetting of pressurized washing liquid into washing liquid already present in said casing, to effect stirring of washing liquid within said casing.

3. The dip-washing machine of claim 1, wherein:

said second subassembly is mounted to said machine frame for movement also to an intermediate position, in which washing liquid can continue to enter through said inlet port while leaking from between said subassemblies into said sump without completely draining from said cavity, for continuous collection from said sump and recycling to said conduit for clean washing liquid.

4. The dip-washing machine of claim 1, further including:

means defining an overflow opening into said sump for excess washing liquid, said overflow being formed through a vertical one of said walls, excepting said bottom wall and said top wall.

* * * * *